US008215992B1

(12) United States Patent
Herrmann

(10) Patent No.: US 8,215,992 B1
(45) Date of Patent: Jul. 10, 2012

(54) ELECTRICAL CONNECTOR HAVING A RESISTOR

(75) Inventor: Henry Otto Herrmann, Elizabethtown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 28 days.

(21) Appl. No.: 12/973,015

(22) Filed: Dec. 20, 2010

(51) Int. Cl.
*H01R 13/66* (2006.01)

(52) U.S. Cl. ..... 439/620.21; 439/620.01

(58) Field of Classification Search ..... 439/620.21, 439/620.01, 620.04
See application file for complete search history.

(56) References Cited

U.S. PATENT DOCUMENTS

| | | | | |
|---|---|---|---|---|
| 4,820,956 | A * | 4/1989 | Slobodzian et al. | 439/620.02 |
| 6,659,783 | B2 | 12/2003 | Copper et al. | |
| 7,149,063 | B2 | 12/2006 | Bryan et al. | |
| 7,266,000 | B2 | 9/2007 | Terdan | |
| 2008/0108252 | A1 * | 5/2008 | Williams | 439/620.08 |
| 2008/0247105 | A1 * | 10/2008 | Divan | 361/56 |

* cited by examiner

*Primary Examiner* — Briggitte R Hammond

(57) ABSTRACT

An electrical connector includes a body having a terminating end and a mating end. A power contact extends from the mating end of the body. The power contact is configured to be engaged by a power contact of a mating connector connected to a predominantly capacitive load. An auxiliary contact extends from the mating end of the body. The auxiliary contact is coupled in series with a resistor. The auxiliary contact configured to be engaged by an auxiliary contact of the mating connector. The auxiliary contact in series with the resistor is configured to engage the mating connector before the power contact to resist a surge current due to the capacitive load from the mating connector.

20 Claims, 5 Drawing Sheets

ELECTRICAL CONNECTOR HAVING A RESISTOR

BACKGROUND OF THE INVENTION

The subject matter described herein relates generally to electrical connectors and, more particularly, to electrical connectors having a resistor.

Existing electrical connectors include ground contacts and power contacts extending therefrom. The power contacts are configured to carry electrical power between the connector and a corresponding mating connector. Generally, connectors and mating connectors are coupled when the power signal is inactive. Accordingly, such "cold mating" does not present problems with power surges across the connectors. However, some connectors and mating connectors may be "hot mated" at a time when a power signal is flowing through one or more of the connectors. Whenever more than a few volts and/or a few amps are available to an interconnection as it is separated or mated, there can be damage to the contacts and connector as well as risk to the operator if the energy is sufficiently high. In spite of this risk, there are many situations that require hot mating between connectors.

Some existing connectors utilize an auxiliary contact with a series PTC (positive temperature coefficient) device. The PTC device can provide protection against damaging results when separating energized DC circuits with inductive and resistive loads. In such a device, a ground contact carries the main current and makes the connection first and separates last. A power contact is the second main current carrying member and makes the connection last and separates first. The auxiliary contact is in series with the PTC device. The auxiliary contact and the PTC device are in parallel with the main power contact. The auxiliary contact provides an intermediate timed connection and separation. As the connector is separated, the main power contact separates first. There is essentially no voltage across this interface as it separates because the voltage is shunted by the auxiliary contact and PTC device. Without sufficient voltage difference, there can be no arcing and therefore no contact damage. During the time the connector continues to separate but before the auxiliary contact separates, the PTC device switches to a high resistance state because the load current now flows through the PTC device. When the auxiliary contact finally separates there is no current flowing through the connection, again preventing a damaging arc at the interface. This arrangement provides protection against the severely damaging plasma arc that can develop at a separating energized interface. This is true for all resistive and inductive loads.

However, PTC devices do not provide protection for systems with capacitive loads. For capacitive loads a significant voltage difference is not normally encountered at separation. With inductive and resistive loads there is generally little damage to the contacts if they have sufficient mass and are mated at an adequate velocity. Existing connector designs provide adequate protection for inductive and resistive loads during separation and mating, but do not provide adequate protection from capacitive loads during mating.

A need remains for a connector that can be hot mated to a mating connector supplying a capacitive load without damaging the contacts or connector.

SUMMARY OF THE INVENTION

In one embodiment, an electrical connector is provided. The electrical connector includes a body having a terminating end and a mating end. A power contact extends from the mating end of the body. The power contact is configured to be engaged by a power contact of a mating connector connected to a predominantly capacitive load. An auxiliary contact extends from the mating end of the body. The auxiliary contact is coupled in series with a resistor. The auxiliary contact configured to be engaged by an auxiliary contact of the mating connector. The auxiliary contact in series with the resistor is configured to engage the mating connector before the power contact to resist a surge current due to the capacitive load from the mating connector.

In another embodiment, an electrical connector is provided. The electrical connector includes a body having a terminating end and a mating end. A power contact extends from the mating end of the body. The power contact is configured to be engaged by a power contact of a mating connector supplying a capacitive load. An auxiliary contact extends from the mating end of the body. The auxiliary contact is configured to be engaged by an auxiliary contact of the mating connector. The auxiliary contact extends from the mating end of the body further than the power contact. The auxiliary contact is configured to engage the mating connector before the power contact. A resistor is electrically coupled in series to the auxiliary contact and configured to resist the capacitive load of the mating connector. The resistor is electrically coupled in parallel to the power contact.

In another embodiment, an electrical connector is provided. The electrical connector includes a body having a terminating end and a mating end. A power contact extends from the mating end of the body. The power contact is configured to engage a power contact of a mating connector carrying a capacitive load. An auxiliary contact extends from the mating end of the body. The auxiliary contact is configured to engage an auxiliary contact of the mating connector before the power contact engages the power contact of the mating connector. A negative temperature coefficient (NTC) device is electrically coupled to the auxiliary contact to limit a surge current of the capacitive load from the mating connector. The NTC device is configured to provide a high resistance to the capacitive load when the auxiliary contact initially engages the mating connector. The resistance of the NTC device is configured to decrease as the NTC device is heated by the charging current of the capacitive load.

DETAILED DESCRIPTION OF THE INVENTION

The foregoing summary, as well as the following detailed description of certain embodiments will be better understood when read in conjunction with the appended drawings. As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 1:
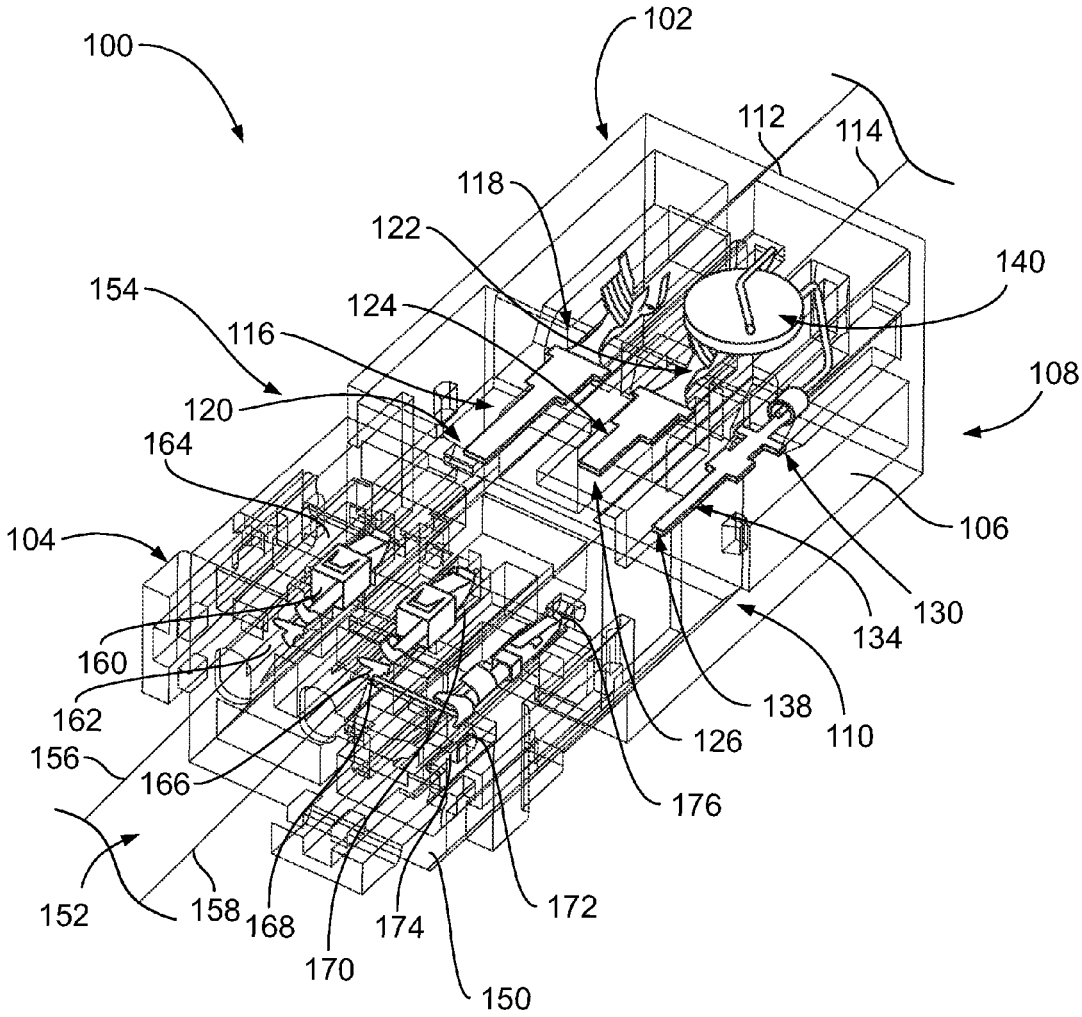
FIG. 1 is a top perspective view of a connector assembly formed in accordance with an embodiment.

FIG. 1 is a top perspective view of a connector assembly 100 formed in accordance with an embodiment. The connector assembly 100 includes a connector 102 and a corresponding mating connector 104. In an example embodiment, the connector 102 may be electrically coupled to an uncharged capacitive load (not shown) and the mating connector 104 may be electrically coupled to an energized power source (not shown). The connector 102 is configured to couple to the mating connector 104. In one embodiment, the connector 102 engages the mating connector 104 to electrically couple the uncharged capacitor and the power source. When the uncharged capacitor is connected to the power source there may be a sudden high surge of current that flows into the uncharged capacitor to bring it up to the supply voltage. This surge can be many times the normal load current.

The connector 102 includes a body 106 having a terminating end 108 and a mating end 110. The terminating end 108 receives wires, cables, or the like from an electrical device (not shown). In particular, the terminating end 108 receives a ground wire 112 and a power wire 114 of the electrical device. A ground contact 116 is positioned within the body 106. The ground contact 116 includes a terminating end 118 and a mating end 120. The terminating end 118 is joined to the ground wire 112. The mating end 120 of the ground contact 116 extends from the mating end 110 of the body 106. A power contact 122 is also positioned within the body 106. The power contact 122 includes a terminating end 124 and a mating end 126. The terminating end 124 of the power contact 122 is joined to the power wire 114. The mating end 126 of the power contact 122 extends from the mating end 110 of the body 106. The terminating end 124 of the power contact 122 includes a resistor 140 joined thereto. The resistor 140 may be a fixed resistor and/or a negative temperature coefficient (NTC) device.

An auxiliary contact 134 is positioned within the body 106. The auxiliary contact 134 includes a terminating end 136 and a mating end 138. The terminating end 136 of the auxiliary contact is joined to the resistor 140 that is coupled to the terminating end 124 of the power contact 122. The mating end 138 of the auxiliary contact 134 extends from the mating end 110 of the body 106.

The mating connector 104 includes a body 150 that is configured to couple to the body 106 of the connector 102. The mating connector body 150 includes a terminating end 152 and a mating end 154. The mating end 154 of the mating connector 104 is configured to couple to the mating end 110 of the connector 102. The terminating end 152 of the mating connector 104 receives wires, cables, or the like from an electrical device (not shown). In one embodiment, the terminating end 152 of the mating connector 104 receives a ground wire 156 and a power wire 158 of the electrical device.

A ground contact 160 is positioned within the body 150 of the mating connector 104. The ground contact 160 includes a terminating end 162 and a mating end 164. The terminating end 162 receives the ground wire 156. The mating end 164 of the ground contact 160 extends from the mating end 154 of the body 150. The mating end 164 of the ground contact 160 of the mating connector 104 is configured to couple to the mating end 120 of the ground contact 116 of the connector 102.

A power contact 166 is positioned within the body 150 of the mating connector 104. The power contact 166 includes a terminating end 168 and a mating end 170. The terminating end 168 of the power contact 166 receives the power wire 158. The mating end 170 of the power contact 166 extends from the mating end 154 of the body 150. The mating end 170 of the power contact 166 of the mating connector 104 is configured to couple to the mating end 126 of the power contact 122 of the connector 102.

Figure 2:
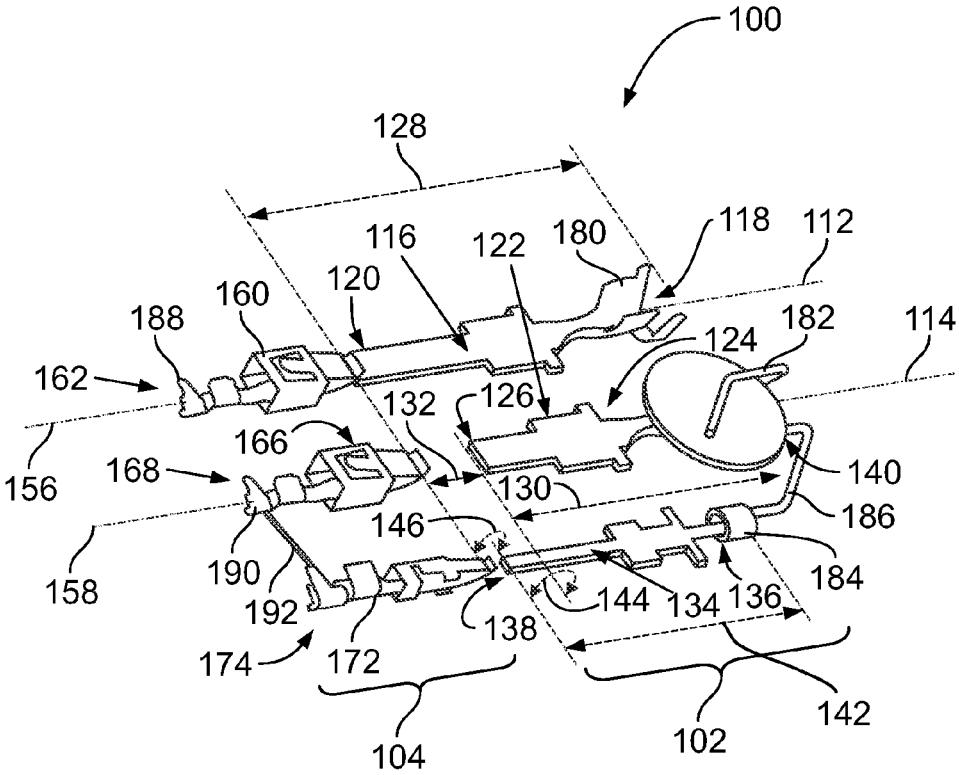
FIG. 2 is a top perspective view of the connector assembly shown in FIG. 1 with the bodies removed.

An auxiliary contact 172 is positioned within the body 150 of the mating connector 104. The auxiliary contact 172 includes a terminating end 174 and a mating end 176. The terminating end 174 is electrically coupled to the terminating end 168 of the power contact 166 (as illustrated in FIG. 2) through wire 192. The mating end 176 of the auxiliary contact 172 extends from the mating end 154 of the body 150. The mating end 176 of the auxiliary contact 172 of the mating connector 104 is configured to couple to the mating end 138 of the auxiliary contact 134 of the connector 102. In the illustrated embodiment, the mating end 176 of the auxiliary contact 172 is aligned with the mating end 170 of the power contact 166 and the mating end 164 of the ground contact 160.

The mating connector 104 couples to the connector 102 to direct current (DC) power between the mating connector 104 and the connector 102. When the mating connector 104 is joined to the connector 102, the ground contacts 116 and 160 are coupled first to establish a ground connection between the mating connector 104 and the connector 102. Next, the auxiliary contacts 134 and 172 are joined. The auxiliary contact 134 of the connector 102 receives the capacitive load of the mating connector 104 from the auxiliary contact 172 of the mating connector 104. The auxiliary contact 134 of the connector 102 is electrically coupled to the resistor 140. The resistor 140 resists the capacitive load of the mating connector 104 by reducing the charging current of the capacitive load flowing between the mating connector 104 and the connector 102. In an embodiment where the resistor 140 is a NTC device, the resistor 140 gradually increases a voltage of the capacitive load in the connector 102 by gradually shifting from a high resistance to a low resistance. After the auxiliary contacts 134 and 172 mate, the current flowing through the resistor 140 causes the resistor 140 to change from a high to a lower resistance value. The initial high resistance value limits an initial current surge to a safe level. Reducing the resistance increases the charging rate to get the capacitive load to a supply voltage by the time the power contacts 122 and 166 touch.

Once the supply voltage is reached, the power contacts 122 and 166 may be joined without creating a damaging current surge between the connector 102 and the mating connector 104. The resistor 140 enables hot-mating of the connector 102 and the mating connector 104 without creating a surge between the connector 102 and the mating connector 104. The resistor 140 prevents possible damage to the connectors 102 and 104, as well as the electrical devices coupled to the connector 102 and the mating connector 104. The resistor 140 also prevents potential injury to an operator joining the connector 102 and the mating connector 104.

FIG. 2 is a top perspective view of the connector assembly 100 with the bodies 106 and 150 of the connector 102 and the mating connector 104, respectively, removed. The ground contact 116 has a length 128 defined between the terminating end 118 and the mating end 120 of the ground contact 116. The power contact 122 has a length 130 defined between the terminating end 124 and the mating end 126 of the power contact 122. The length 128 of the ground contact 116 is greater than the length 130 of the power contact 122. The ground contact 116 extends from the mating end 110 of the body 106 further than the power contact 122. The mating end 120 of the ground contact 116 extends a distance 132 further from the mating end 110 of the body 106 than the mating end 126 of the power contact 122.

The auxiliary contact 134 has a length 142 that is defined between the terminating end 136 and the mating end 138 of the auxiliary contact 134. The length 142 of the auxiliary contact 134 may be greater than, less than, or equal to the length 128 of the ground contact 116. The length 142 of the auxiliary contact 134 may be greater than, less than, or equal to the length 130 of the power contact 122. The auxiliary contact 134 is positioned within the body 106 so that the mating end 138 of the auxiliary contact 134 extends further from the mating end 110 of the body 106 than the mating end 126 of the power contact 122. The mating end 138 of the auxiliary contact 134 extends a distance 144 further from the mating end 110 of the body 106 than the mating end 126 of the power contact 122. The auxiliary contact 134 is positioned within the body 106 so that the mating end 120 of the ground contact 116 extends further from the mating end 110 of the body 106 than the mating end 138 of the auxiliary contact 134. The mating end 120 of the ground contact 116 extends a distance 146 further from the mating end 110 of the body 106 than the mating end 138 of the auxiliary contact 134.

The ground contact 116 of the connector 102 includes a terminal 180 at the terminating end 118 of the ground contact 116. The ground wire 112 is positioned within the terminal 180. The terminal 180 is clamped into a closed position to retain the ground wire 112 and create an electrical connection between the ground wire 112 and the ground contact 116.

The power contact 122 includes the resistor 140 joined to the terminating end 124 thereof. An intermediate contact 182 extends from the resistor 140 to the power contact 122 to couple the resistor 140 in parallel with the power contact 122. The power contact 122 is also joined to the power wire 114 to create an electrical connection between the power contact 122 and the power wire 114.

The auxiliary contact 134 includes a terminal 184 at the terminating end 136 thereof. The terminal 184 is coupled to a resistor lead 186. The resistor lead 186 extends between the auxiliary contact 134 and the resistor 140 to electrically couple the auxiliary contact 134 and the resistor 140 in series.

The ground contact 160 of the mating connector 104 includes a terminal 188 at the terminating end 162 thereof. The terminal 188 receives the ground wire 156 of the electrical power source. The terminal 188 is crimped or otherwise secured to the ground wire 156 to retain the ground wire 156 and create an electrical connection with the ground wire 156.

The power contact 166 includes a terminal 190 at the terminating end 168 thereof. The terminal 190 receives the power wire 158 of the electrical power source. The terminal 190 is crimped or otherwise secured to the power wire 158 to retain the power wire 158 and create an electrical connection between the power wire 158 and the power contact 166.

The auxiliary contact 172 includes an intermediate contact 192 at the terminating end 174 thereof. The intermediate contact 192 extends between the auxiliary contact 172 and the power contact 166 to electrically couple the auxiliary contact 172 and the power contact 166. The auxiliary contact 172 and the power contact 166 are electrically coupled in parallel.

The auxiliary contacts 172 and 134 in series with the resistor 140 are electrically coupled in parallel with the power contacts 122 and 166, respectively, so that the capacitive charge of the mating connector 104 may be directed through the auxiliary contacts 172 and 134 and resistor. The resistor 140 controls the charging current to the capacitive load to increase a charging rate and get the capacitive load to a supply voltage by the time the power contacts 122 and 166 touch. Once the supply voltage is reached, the power contacts 122 and 166 may be joined without creating a surge between the connector 102 and the mating connector 104.

Figure 3:
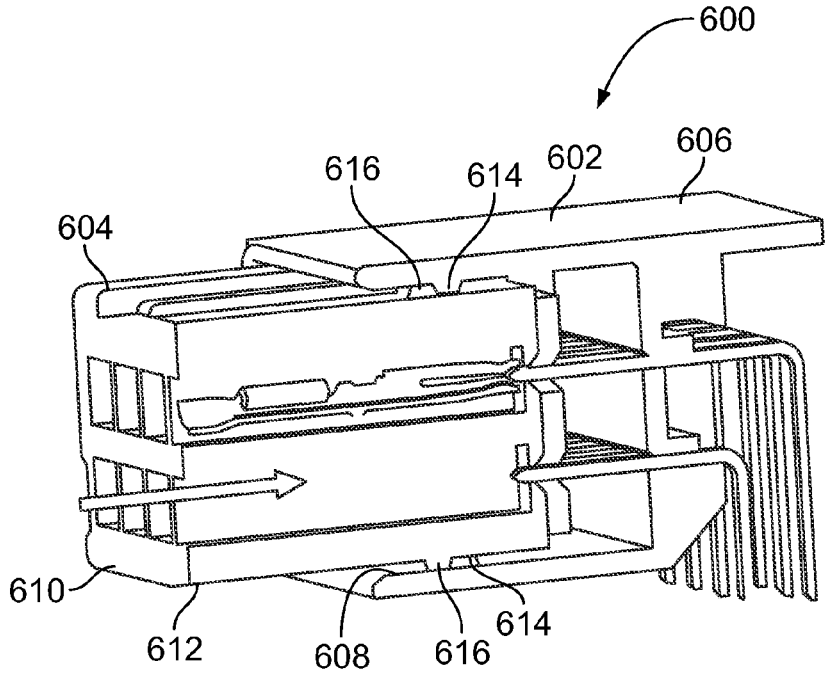
FIG. 3 is a cross-sectional view of another connector assembly functionally like that shown in FIG. 1 and with the connector and the mating connector coupled.

FIG. 3 is a cross-sectional view of another connector assembly 600 that is functionally similar to 100. The connector assembly 600 includes a connector 602 and a mating connector 604. The connector assembly 600 provides one means of controlling the timing of the mating sequence. A connector body 606 includes an inner surface 608. A mating connector body 610 includes an outer surface 612. The mating connector body 610 is received within the connector body 606. The inner surface 608 of the connector body 606 includes detents 614 extending therefrom. The detents 614 extend inward from the connector body 606. The mating connector body 610 includes detents 616 extending therefrom. The detents 616 extend outward from the mating connector body 610. The detents 614 and 616 control a timing at which auxiliary contacts (not shown) and the power contacts (not shown) of the connector 602 and the mating connector 604 engage.

When the mating connector body 610 is received within the connector body 606, the detents 614 and 616 engage one another as illustrated in FIG. 3. The detents 614 and 616 engage one another at the time that the ground contacts 618 and 620 engage one another. In one embodiment, the connector body 606 is flexible so that the detents 614 and 616 may pass over one another. Alternatively, the detent 614 and/or the detent 616 may deform to enable the detents 614 and 616 to pass over one another. The auxiliary contacts become engaged as the detents 614 and 616 pass over one another. When the detent 614 passes the detent 616, the connector body 606 and the mating connector body 610 snap together to couple the power contacts. Accordingly, the detents 614 and 616 operate as a timing mechanism to control the engagement of the auxiliary contacts and the power contacts. The detents 614 and 616 time the engagement of the auxiliary contacts and the power contacts so that the supply voltage is reached in the connector 602 before the power contacts engage.

Figure 4:
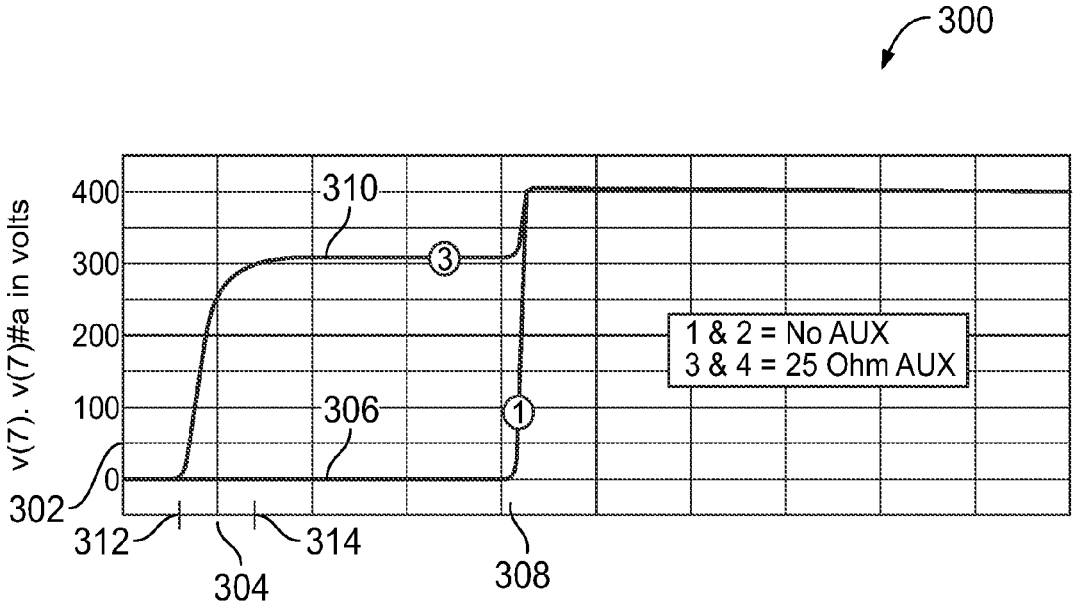
FIG. 4 is a graph illustrating two alternative examples of a voltage at a capacitive load as different connector configurations are hot mated with a mating connector.

FIG. 4 is a graph 300 illustrating a voltage at the capacitive load as the connector is hot mated with a mating connector. The graph 300 includes a y-axis 302 illustrating the voltage at the capacitive load. The x-axis 304 illustrates time in milliseconds. The graph 300 includes a first line 306 representing the voltage using a connector that does not include a resistor and auxiliary contacts. As illustrated by line 306, the connector lacking a resistor does not experience any voltage from the capacitive load until the power contact of the connector engages the power contact of the mating connector. The power contacts are engaged just after 8 ms at point 308. At point 308 the voltage at the capacitive load jumps from 0 V to 400 V. Such a jump in voltage results from a large current surge which may be damaging to the connector. Moreover, the jump in voltage may result in injury to an operator joining the connector and the mating connector.

Graph 300 includes a second line 310 representing the voltage in a connector having an auxiliary contact joined to a fixed resistor, for example a fixed 25 ohm resistor. The fixed resistor resists the capacitive load of the mating connector so that the voltage of the capacitive load is gradually received by the connector. In particular, the connector initially receives 0 V from the mating connector. The auxiliary contacts become engaged at approximately 1 ms at point 312. The resistor creates a gradual voltage increase in the connector between point 312 and point 314 (approximately 3 ms). The resistor increases the voltage in the connector between point 312 and 314 to approximately 300 V. Accordingly, when the power contacts engage at point 308, the voltage in the connector only jumps 100 volts from 300 V to 400 V.

As illustrated in FIG. 4, a fixed resistor enables a gradual increase in voltage through the connector. Accordingly, the fixed resistor reduces the jump in voltage experienced by the capacitive load when the power contacts are engaged. The reduced jump in voltage is the result of limiting the surge current and that reduces damage to the connector and the mating connector and/or injury to the operator.

Figure 5:
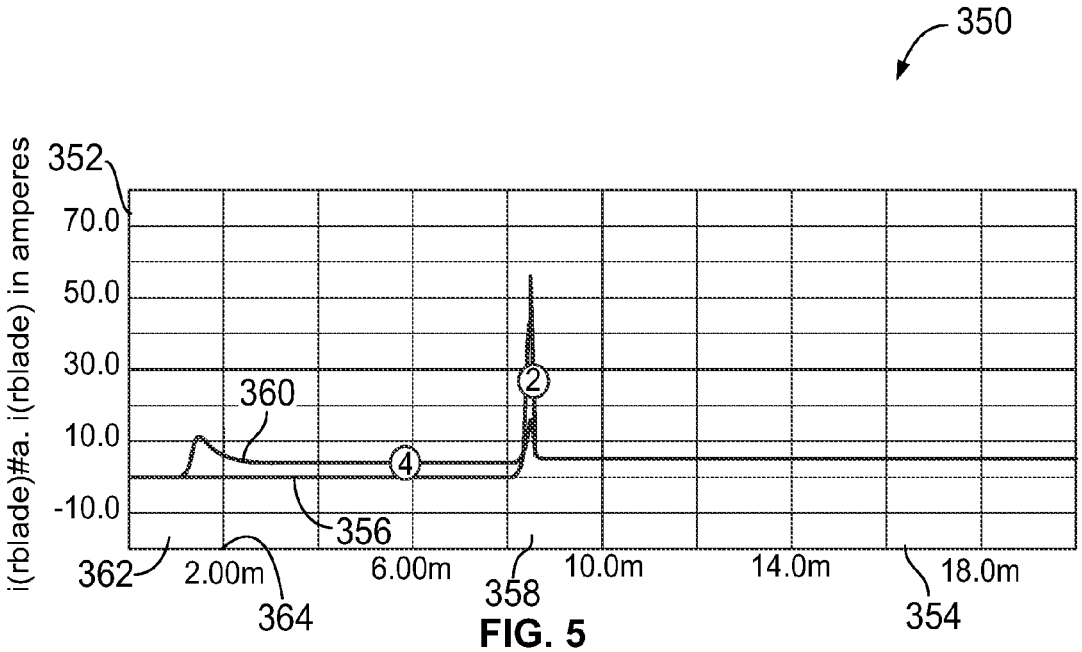
FIG. 5 is a graph illustrating two alternative examples of a current through different connector configurations as the different connectors are hot mated with a mating connector.

FIG. 5 is a graph 350 illustrating a current through a connector as the connector is hot mated with a mating connector. The graph 350 illustrates current on the y-axis 352 in Amperes and time on the x-axis 354 in milliseconds.

The graph 350 includes a first line 356 representing the current through a connector that does not include a resistor and auxiliary contacts. As illustrated in line 356, the connector does not receive any current from the capacitive load of the mating connector until point 358 after 8 ms. Point 358 represents the time at which the power contacts of the connector and the mating connector become engaged. At point 358, the connector experiences a spike in current from 0 A to approximately 55 A. Such a current spike may be damaging to the connector. Moreover, the spike in current may result in injury to an operator joining the connector and the mating connector.

The graph 350 includes a second line 360 representing the current through a connector having a fixed resistor, for example a fixed 25 ohm resistor, and an auxiliary contact. At point 362, at approximately 1 ms, the auxiliary contacts of the connector and the mating connector are joined. At point 362, the connector experiences an increase in current to approximately 10 A. The current then reduces at point 364 to approximately 5 A. At point 358, the power contacts are joined and the current in the connector increases to approximately 15 A before being reduced to approximately 6 A.

As illustrated in FIG. 5, a fixed resistor reduces the jump in current experienced by the connector when the power contacts are engaged. The reduced jump in current reduces damage to the connector and the mating connector and/or injury to the operator.

Figure 6:
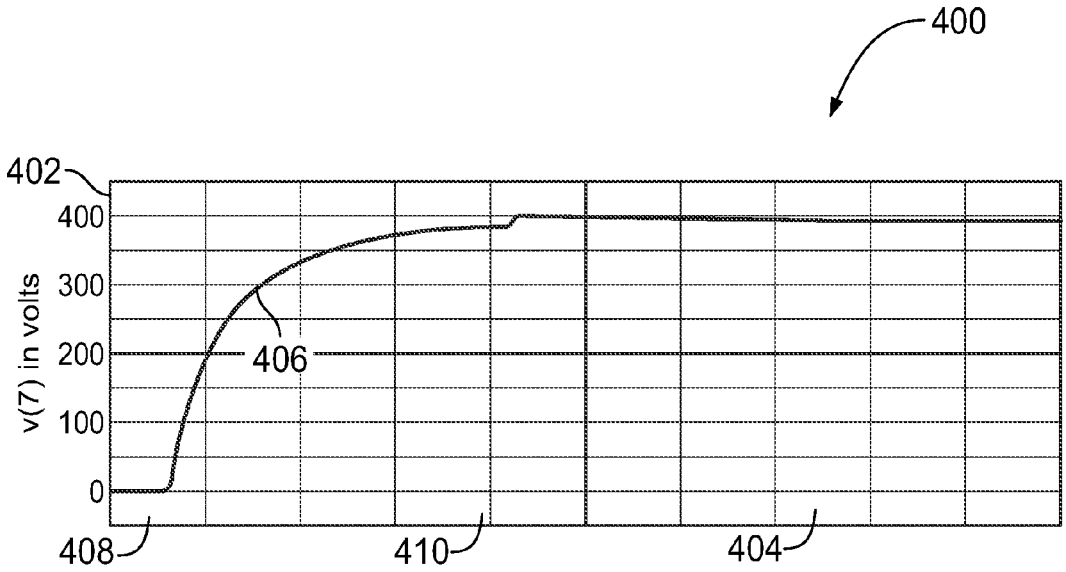
FIG. 6 is a graph illustrating a voltage at a capacitive load using an alternative connector as the connector is hot mated with a mating connector.

FIG. 6 is a graph 400 illustrating a voltage through an alternative connector as the connector is hot mated with a mating connector. The graph 400 includes a y-axis 402 representing voltage and an x-axis 404 representing time. The graph 400 includes a line 406 that represents the voltage in a connector having an NTC device coupled in series with an auxiliary contact. At point 408, at approximately 1 ms, the auxiliary contacts of the connector and the mating connector are engaged. At point 408, the voltage at the capacitive load gradually increases from 0 V to 380 V. At point 410, the power contacts of the connector and the mating connector are engaged and the voltage in the connector jumps 20 volts to 400 V.

Compared to line 306 in FIG. 4, the connector of FIG. 6 experiences a much lower jump in voltage when the power contacts are engaged. In particular, the connector of line 306 experiences a 400 V spike when the power contacts are engaged. In contrast, the connector of FIG. 6 experiences only a 20 V spike when the power contacts are engaged. As illustrated in FIG. 6, an NTC device enables a gradual increase in voltage at the capacitive load thereby significantly reducing the charging current surge. Accordingly, the NTC device reduces the jump in voltage experienced by the connector when the power contacts are engaged. The reduced jump in voltage is the result of limiting the surge current and that reduces damage to the connector and the mating connector and/or injury to the operator.

Figure 7:
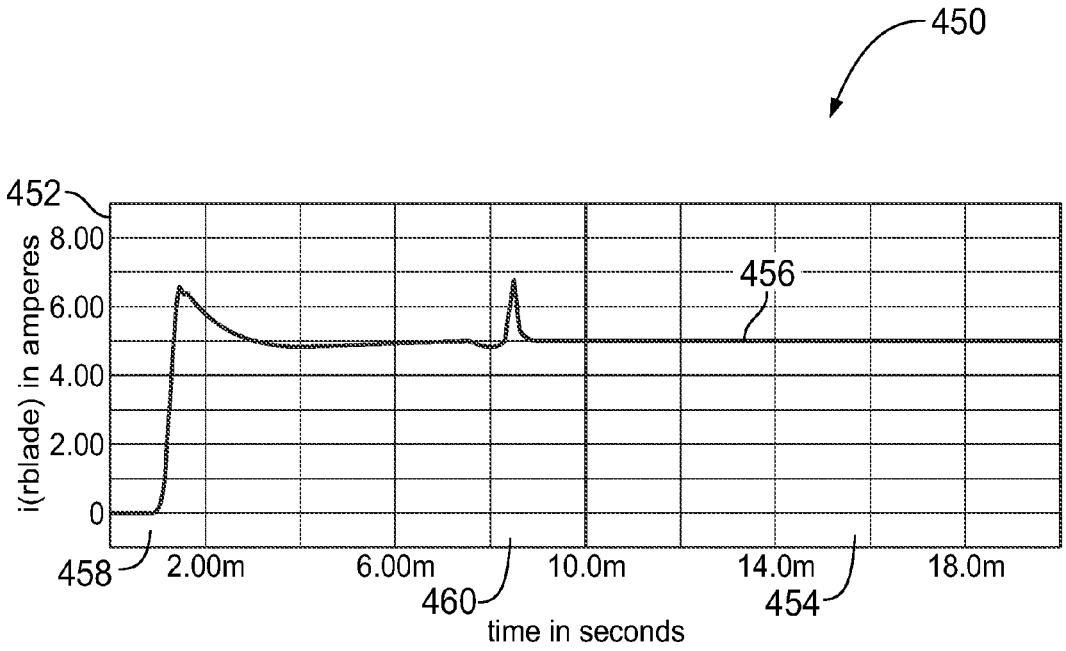
FIG. 7 is a graph illustrating a current through an alternative connector as the connector is hot mated with a mating connector.

FIG. 7 is a graph 450 illustrating a current through an alternative connector as the connector is hot mated with a mating connector. The graph 450 includes a y-axis 452 representing current and an x-axis 454 representing time. The graph 450 includes a line 456 that represents the current in a connector having an NTC device coupled in series with an auxiliary contact. At point 458, at approximately 1 ms, the auxiliary contacts of the connector and the mating connector are engaged. At point 458, the current in the connector increases from 0 A to 6.5 A before reducing to 5 A. At point 460, the power contacts of the connector and the mating connector become engaged and the current in the connector jumps to 6.5 A before reducing back to 5 A.

Compared to line 356 in FIG. 5, the connector of FIG. 7 experiences a much lower spike in current when the power contacts are engaged. In particular, the connector of line 356 experiences a 55 A spike when the power contacts are engaged. In contrast, the connector of FIG. 7 experiences only a 1.5 A spike when the power contacts are engaged. As illustrated in FIG. 7, an NTC device enables a gradual increase in current at the capacitive load. Accordingly, the NTC device reduces the jump in current experienced by the connector when the power contacts are engaged. The reduced jump in current significantly reduces damage to the connector and the mating connector and/or injury to the operator.

Figure 8:
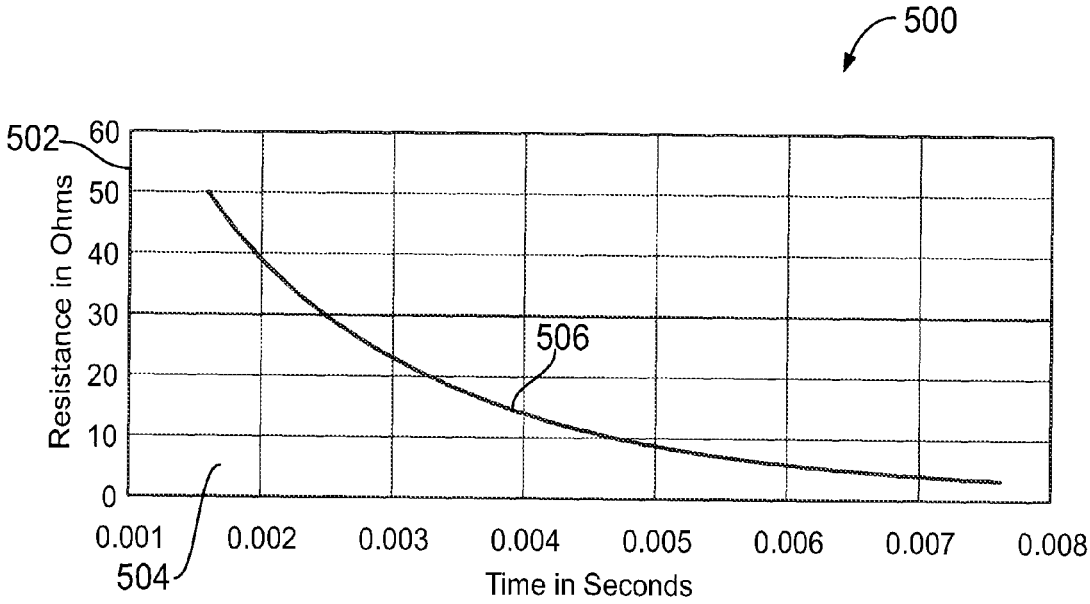
FIG. 8 is a graph illustrating a resistance of a negative temperature coefficient (NTC) device as the NTC device is heated by the charging current of a capacitive load.

FIG. 8 is a graph 500 illustrating a resistance of an NTC device as the NTC device is heated by the charging current of a capacitive load. The graph 500 has a y-axis 502 representing resistance in Ohms and an x-axis 504 representing time in milliseconds. The line 506 represents the resistance of an NTC device while the auxiliary contacts are connected, but prior to the connection of the power contacts. As illustrated by line 506, the resistance in the NTC device gradually decreases to allow the connector to receive the capacitive charge from the mating connector.

It should be noted that there is no danger of generating a damaging plasma arc when the connection between the connector and the mating connector is separated at sufficient velocity as controlled by the housing design. There will be no significant voltage between the separating contacts because the capacitive load will have stored electrical energy that takes some time to deplete.

The connector assembly has a further advantage over the use of an NTC internal to a capacitive load. When NTC devices are used for surge suppression they are simply connected in series with that load. Since the NTC device does not reduce to an insignificant resistance there will always be a loss across them. There is also heat generated by that loss. The connector assembly eliminates both the loss and the heat because the NTC device is shunted by the main power contact when the connector is fully engaged. The connector assembly improves system efficiency as well as reducing the cooling load.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the invention without departing from their scope. While the dimensions and types of materials described herein are intended to define the parameters of the various embodiments of the invention, the embodiments are by no means limiting and are exemplary embodiments. Many other embodiments will be apparent to those of skill in the art upon reviewing the above description. The scope of the various embodiments of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments of the invention, including the best mode, and also to enable any person skilled in the art to practice the various embodiments of the invention, including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. An electrical connector comprising:

a body having a terminating end and a mating end;

a power contact extending from the mating end of the body, the power contact configured to be engaged by a power contact of a mating connector connected to a predominantly capacitive load; and an auxiliary contact extending from the mating end of the body, the auxiliary contact coupled in series with a resistor, the auxiliary contact configured to be engaged by an auxiliary contact of the mating connector, wherein the auxiliary contact in series with the resistor is configured to engage the mating connector before the power contact to resist a surge current due to the capacitive load from the mating connector.

2. The electrical connector of claim 1, wherein the resistor is a negative temperature coefficient (NTC) device that provides a high resistance to the capacitive load when the auxiliary contact initially engages the mating connector, the resistance of the NTC device decreasing as the NTC device is heated by the capacitive load.

3. The electrical connector of claim 1, wherein the body includes a timing mechanism that controls a timing of the auxiliary contact and the power contact engaging the mating connector.

4. The electrical connector of claim 1, wherein the resistor and the auxiliary contact are electrically coupled in parallel with the power contact.

5. The electrical connector of claim 1, wherein the auxiliary contact extends from the mating end of the body further than the power contact.

6. The electrical connector of claim 1 further comprising a ground contact, the ground contact extending from the mating end of the body further than the auxiliary contact.

7. The electrical connector of claim 1, wherein the resistor reduces the surge current of the capacitive load from the mating connector.

8. The electrical connector of claim 1, wherein the resistor gradually increases a voltage in the capacitive load.

9. An electrical connector comprising:

a body having a terminating end and a mating end;

a power contact extending from the mating end of the body, the power contact configured to be engaged by a power contact of a mating connector supplying a capacitive load;

an auxiliary contact extending from the mating end of the body, the auxiliary contact configured to be engaged by an auxiliary contact of the mating connector, the auxiliary contact extending from the mating end of the body further than the power contact, the auxiliary contact configured to engage the mating connector before the power contact; and a resistor electrically coupled in series to the auxiliary contact and configured to resist the capacitive load of the mating connector, the resistor electrically coupled in parallel to the power contact.

10. The electrical connector of claim 9, wherein the capacitive load is charged gradually by the resistor to reduce a current surge through the power contact.

11. The electrical connector of claim 9, wherein the resistor is a negative temperature coefficient (NTC) device that provides a high resistance to the capacitive load when the auxiliary contact initially engages the mating connector, the resistance of the NTC device decreasing as the NTC device is heated by the capacitive load charging current.

12. The electrical connector of claim 9, wherein the body includes a timing mechanism that controls a timing of the auxiliary contact and the power contact engaging the mating connector.

13. The electrical connector of claim 9 further comprising a ground contact, the ground contact extending from the mating end of the body further than the auxiliary contact.

14. The electrical connector of claim 9, wherein the resistor reduces a surge current of the capacitive load from the mating connector.

15. The electrical connector of claim 9, wherein the resistor gradually increases a voltage in the capacitive load.

16. An electrical connector comprising:

a body having a terminating end and a mating end;

a power contact extending from the mating end of the body, the power contact configured to engage a power contact of a mating connector carrying a capacitive load;

an auxiliary contact extending from the mating end of the body, the auxiliary contact configured to engage an auxiliary contact of the mating connector before the power contact engages the power contact of the mating connector; and a negative temperature coefficient (NTC) device electrically coupled to the auxiliary contact to limit a surge current of the capacitive load from the mating connector, the NTC device configured to provide a high resistance to the capacitive load when the auxiliary contact initially engages the mating connector, the resistance of the NTC device configured to decrease as the NTC device is heated by the charging current of the capacitive load.

17. The electrical connector of claim 16, wherein the capacitive load is resisted by the NTC device to reduce a current surge across the power contact.

18. The electrical connector of claim 16, wherein the NTC device and the auxiliary contact are electrically coupled in parallel with the power contact.

19. The electrical connector of claim 16, wherein the auxiliary contact extends from the mating end of the body further than the power contact.

20. The electrical connector of claim 16 further comprising a ground contact, the ground contact extending from the mating end of the body further than the auxiliary contact.

* * * * *